United States Patent [19]

Rais

[11] Patent Number: 5,062,209

[45] Date of Patent: Nov. 5, 1991

[54] USE INDICATOR FOR A DISPOSABLE RAZOR

[76] Inventor: Elliot Rais, 60 Sutton Place South, New York, N.Y. 10022

[21] Appl. No.: 558,718

[22] Filed: Jul. 27, 1990

[51] Int. Cl.[5] ..... B26B 108; G09F 9/00

[52] U.S. Cl. ..... 30/41.7; 116/323

[58] Field of Search ..... 30/41.7; 116/322, 323, 116/324

[56] References Cited

U.S. PATENT DOCUMENTS 2,328,336 8/1943 Gilford ..... 30/41.7

4,208,984 6/1980 Glanzman ..... 116/323

4,268,958 5/1981 Hilbert ..... 30/41.7

*Primary Examiner*—Douglas D. Watts

*Assistant Examiner*—Paul M. Heyrana, Sr.

*Attorney, Agent, or Firm*—Sprung Horn Kramer & Woods

[57] ABSTRACT

A disposable razor comprising a blade holder, a blade in the blade holder, a handle connected to the blade holder and a blade cover. In order to indicate the number of times the blade has been used, tabs are integrally formed on the handle, blade holder or the blade cover and bendable about a pivot line from a first position indicating non-use to a second position indicating one use and indicia associated with each tab.

9 Claims, 4 Drawing Sheets

USE INDICATOR FOR A DISPOSABLE RAZOR

BACKGROUND OF THE INVENTION

The present invention relates to a use indicator for a disposable razor.

Many attempts have been made to indicate the number of times that a blade has been used for shaving so that the user can pick up a razor without having to remember the number of previous uses. Such devices have been disclosed in U.S. Pat. Nos. 1,896,380, 3,879,844, 2,326,774, 2,680,290, 3,137,939, 1,600,126, 1,275,517 and 2,785,486.

However all of these attempts involve cumbersome devices or methods which are not usually implemented on modern day razors and in particular on disposable razors, blade holders or blade covers.

SUMMARY OF THE INVENTION

The main object of the present invention is to eliminate the disadvantages of the prior art devices.

Another object of the present invention is to provide a device for indicating uses of a razor which is suitable for disposable razors, blade holders or blade covers and in particular disposable razors, blade holders or blade covers made out of plastic.

These and other objects and advantages of the present invention are achieved in accordance with the present invention by tabs which are integrally formed on the handle of a razor, the blade holder of the razor or the blade cover of a razor and which are bendable about a pivot line from a first position indicating non-use to a second position indicating one use and indicia associated with each tab.

These and other features of the present invention will become clear from the following detailed description taken with the attached drawings, wherein:

DETAILED DESCRIPTION OF THE INVENTION

Figure 1:
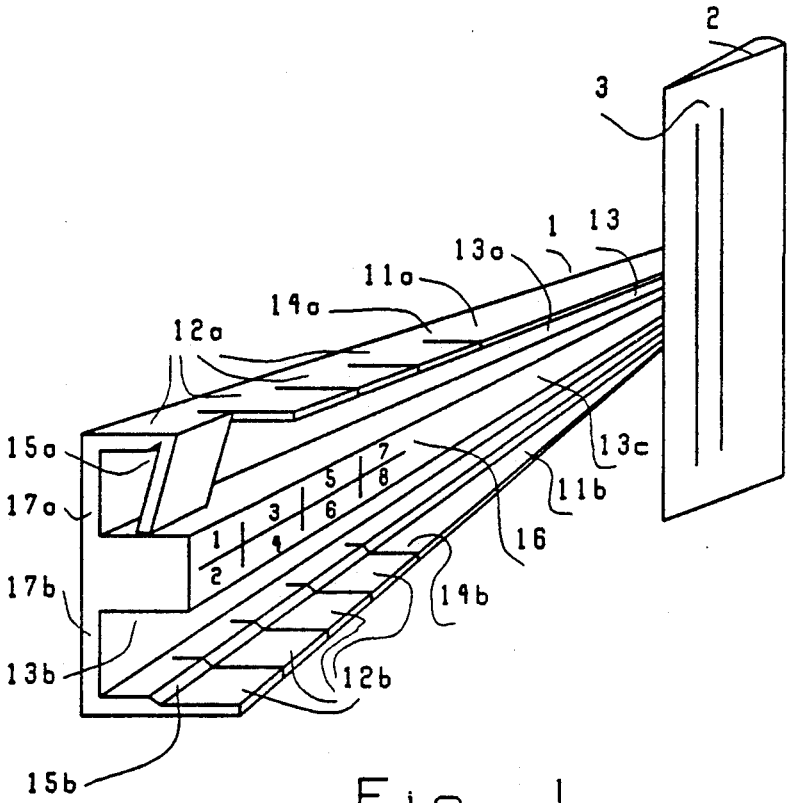
FIG. 1 is a perspective view of one embodiment of the present invention with a use indicator on a handle.

FIG. 1 shows one embodiment of the present invention wherein the disposable razor includes a handle one preferably made of plastic, a blade holder 2 connected to the handle and holding a blade 3. The blade holder 2 is preferably made of plastic and integrally formed with the handle 1.

Handle 1 is a drawn or extruded member having a central portion 13 having side faces 13*a* and 13*b* and a top face 13*c* bearing indicia 16 relating to the number of uses of the blade. In this case the indicia include the numbers 1–8.

The handle also includes two side strips 11*a* and 11*b* which are connected to the central member 13 via base portion 17*a* and 17*b*. At the end of side strips 11*a* and 11*b* are integrally formed tabs 12*a* and 12*b* which are separated from each other by slits 14*a* and 14*b*. The tabs are bendable about pivot lines 15*a* and 15*b* and are pivotable from the normal position indicating non-use to the bent position wherein the free end of each tab is wedged against side wall 13*a*, 13*b* of number 13. Alternatively, with a more brittle plastic each tab can be bent and broken off.

As can be seen from FIG. 1, the slits 14*a*, 14*b* extend downwardly past the pivot lines 15*a* and 15*b* so that the tabs, when bent, are able to flex rearwardly away from side walls 13*a*, 13*b* to apply a force to keep the tab in the bent position shown.

The user therefore bends down one tab each time he or she uses the razor. The tab that is bent down is the one that corresponds to the next consecutive number shown by the indicia 16.

Figure 2:
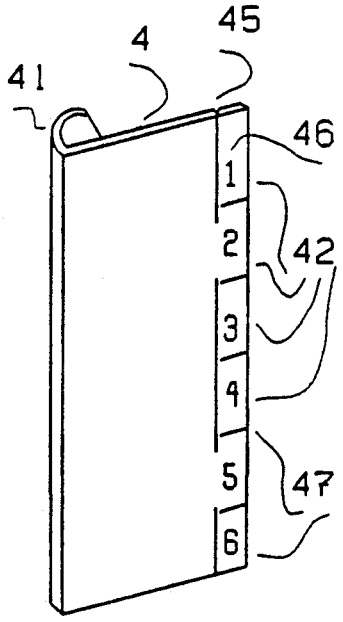
FIG. 2 is another embodiment of the invention wherein the use indicator is on the blade cover.

FIG. 2 shows another embodiment of the invention wherein the blade holder cover 4 which is normally configured to fit over the blade holder 2 has a plurality of tabs 42 thereon, which are separated by slits 47 and which are pivotable about a break line 45. In use, the blade holder has the curved portion 41 received over the blade holder 2. When the user is to use the blade, the user merely bends one of the tabs 42 around the break line 45 and removes it. The indicia 46 on the tabs 42 indicates to the user which tab should be consecutively removed.

Figure 3:
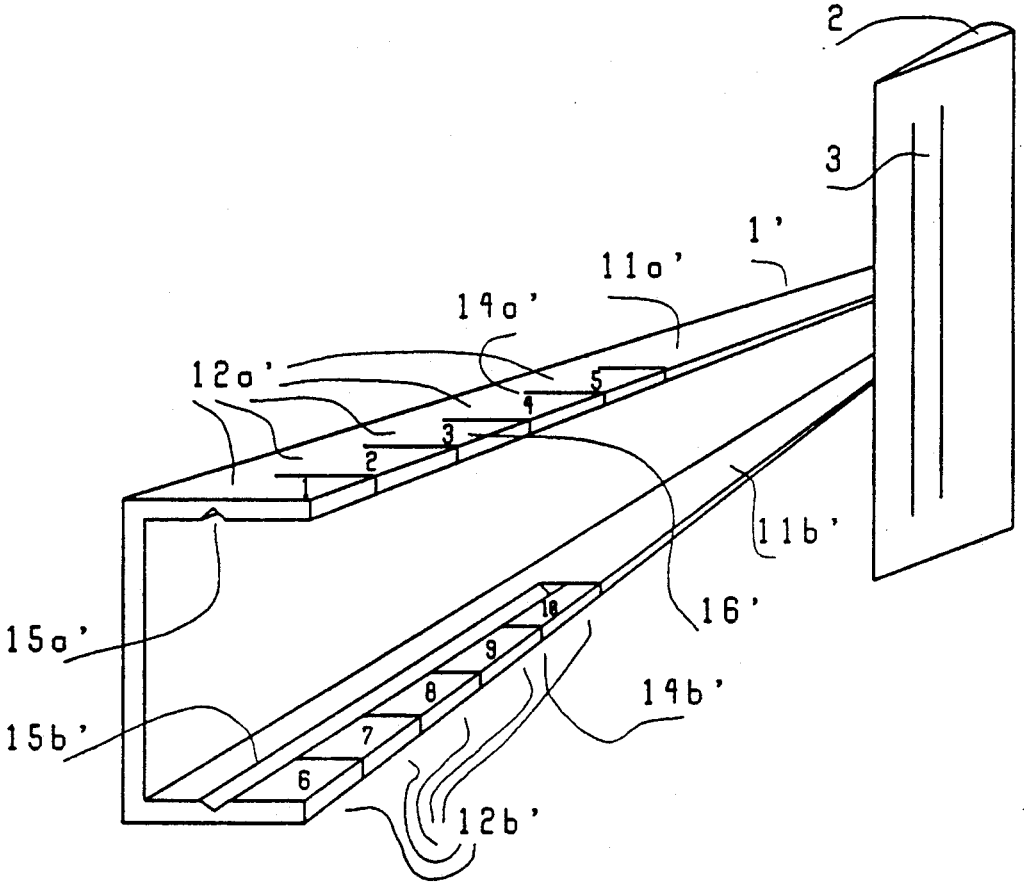
FIG. 3 is a perspective view of another embodiment of the present invention with the use indicator on the handle.

FIG. 3 shows another embodiment of the present invention wherein the handle 1' has only side members 11*a'* and 11*b'*. At the ends of the side members, are the tabs 12*a'* and 12*b'* separated by slits 14*a'* and 14*b'*. The tabs are bendable about the break lines 15*a'* and 15*b'* so that the user need only bend each tab consecutively and remove same. Each tab includes indicia 16' thereon to indicate the number of the use.

Figure 4:
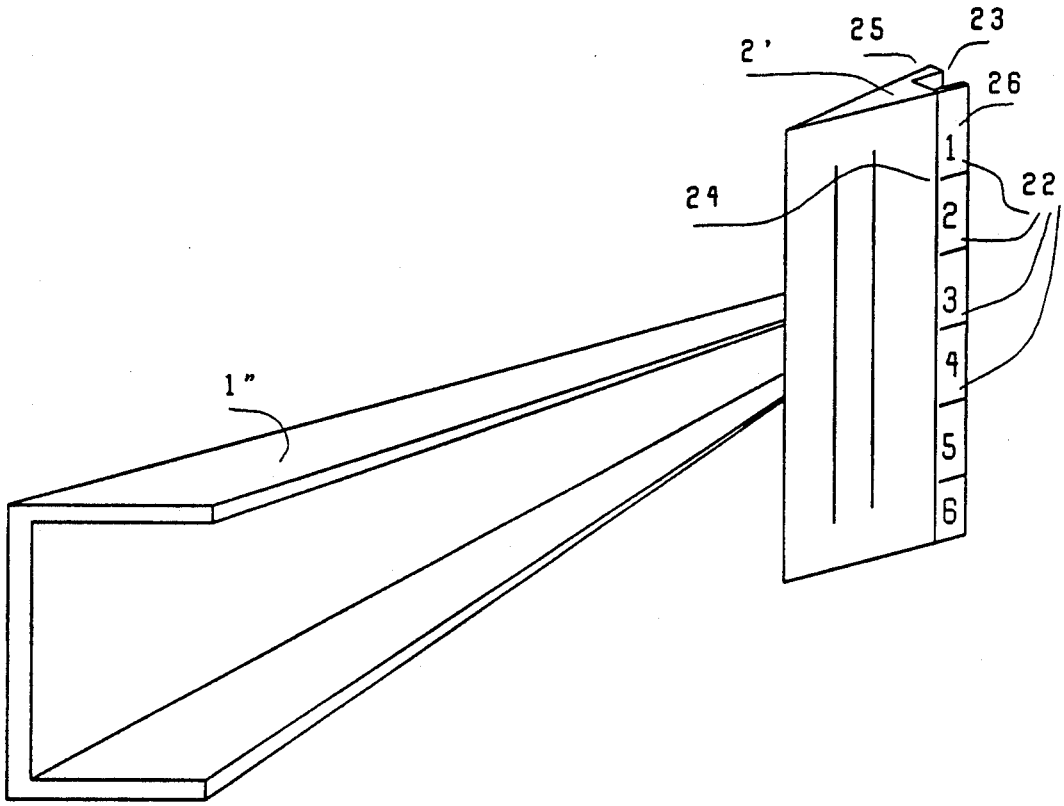
FIG. 4 is a perspective view of another embodiment wherein the use indicator is on the blade holder.

In still a further embodiment of the present invention shown in FIG. 4, the handle 1'' is connected to a blade holder 2' which has a plurality of tabs 22 thereon separated by slits 24 and bearing indicia 26. The tabs are bendable about a pivot line 25 so that the free end thereof wedges against member 23. Alternatively, with a more brittle plastic the tabs can be bent and broken off.

In use, the user need only bend down each tab 22 from the position shown to the bent position or snap the tab off to indicate use and the number on the tabs still in a non-use position indicate the number of uses of the blade. Alternatively, with a more brittle plastic the tabs can be bent and broken off.

What is claimed is:

1. A disposable razor comprising a blade holder, a blade in the blade holder, a handle connected to the blade holder and means for indicating the number of times the blade has been used comprising tabs integrally formed on the handle and bendable about a pivot line from a first position indicating non-use to a second position indicating one use and indicia associated with each tab.

2. The disposable razor according to claim 1, wherein the pivot line comprises a break line and wherein movement to the second position effects removal of the tab.

3. The disposable razor according to claim 1, further comprising means for retaining each tab in the second position comprising a surface integral with the handle and configured to be contacted with a free end of the tab when the tab is moved into the second position.

4. The disposable razor according to claim 3, wherein the tabs are disposed side by side with a space therebetween extending downwardly below the pivot line.

5. A blade cover for a disposable razor having a blade holder with a blade therein, comprising: a member configured to be removably mountable on a blade holder and having means for indicating the number of times the blade has been used comprising tabs integrally formed on the blade cover and bendable about a pivot line from a first position indicating non-use to a second position indicating one use and indicia associated with each tab.

6. The blade cover according to claim 5, wherein the pivot line comprises a break line and wherein movement to the second position effects removal of the tab.

7. A disposable razor comprising a blade holder, a blade in the blade holder, a handle releasably connectable to the blade holder and means for indicating the number of times the blade has been used comprising tabs integrally formed on the blade holder and bendable about a pivot line from a first position indicating non-use to a second position indicating one use and indicia associated with each tab.

8. The disposable razor according to claim 7, wherein the pivot line comprises a break line and wherein movement to the second position effects removal of the tab.

9. The disposable razor according to claim 7, further comprising means for retaining each tab in the second position comprising a surface integral with the blade holder and configured to be contacted with a free end of the tab when the tab is moved into the second position.

* * * * *